US006170505B1

(12) United States Patent
Erwin

(10) Patent No.: US 6,170,505 B1
(45) Date of Patent: Jan. 9, 2001

(54) AUTOMOTIVE-FLUID REPLACEMENT APPARATUS

(75) Inventor: Harold E. Erwin, Augusta, KS (US)

(73) Assignee: BG Products, Inc., Wichita, KS (US)

( * ) Notice: Under 35 U.S.C. 154(b), the term of this patent shall be extended for 0 days.

(21) Appl. No.: 09/370,042

(22) Filed: Aug. 6, 1999

(51) Int. Cl.[7] ..... F16N 33/00

(52) U.S. Cl. ..... 137/1; 137/565.17; 137/899; 184/1.5

(58) Field of Search ..... 137/565.17, 899, 137/1; 184/1.5

(56) References Cited

U.S. PATENT DOCUMENTS

| | | | | |
|---|---|---|---|---|
| 1,506,652 | * | 8/1924 | Maker | 184/1.5 X |
| 2,158,914 | * | 5/1939 | Rinehart | 184/1.5 X |
| 3,095,062 | * | 6/1963 | Neely | 184/1.5 X |
| 3,867,999 | * | 2/1975 | Cox | 184/1.5 |
| 4,095,673 | * | 6/1978 | Takeuchi | 184/1.5 |
| 4,240,523 | * | 12/1980 | Nestor et al. | 184/1.5 |
| 4,354,574 | * | 10/1982 | Kieber | 184/1.5 |
| 4,938,315 | * | 7/1990 | Ohta et al. | 184/1.5 |
| 5,056,621 | * | 10/1991 | Trevino | 184/1.5 |
| 5,562,181 | * | 10/1996 | Elkin et al. | 184/1.5 |
| 5,853,068 | * | 12/1998 | Dixon et al. | 184/1.5 |

* cited by examiner

*Primary Examiner*—John Rivell
(74) *Attorney, Agent, or Firm*—Shook, Hardy & Bacon L.L.P.

(57) ABSTRACT

An apparatus is provided for replacing the fluid employed in a vehicle component, and includes a bi-directional pump having first and second ports to which service, supply and drain lines are connected. The service line is connected to the first port and includes a free end adapted for receipt in the reservoir of the vehicle. The supply line is connected to the second port and includes a free end adapted for receipt in a replacement-fluid container. In addition the supply line includes a check valve that permits fluid flow in a direction toward the pump while preventing the flow of fluid in a direction away from the pump. The drain line is connected to the second port and includes a check valve that permits fluid flow in a direction away from the pump while preventing the flow of fluid in a direction toward the pump. A switch controls operation of the pump, and is movable between an "off" position in which the pump is off, a first "on" position in which the pump operates in a first direction forcing fluid from the first port to the second port so that fluid is drained from the reservoir, and a second "on" position in which the pump operates in a second direction forcing fluid from the second port to the first port so that fluid from the container is pumped into the reservoir. By cycling operation of the pump between the first and second "on" positions with the lines properly positioned, the fluid in the reservoir of the vehicle component is drained and replaced.

11 Claims, 2 Drawing Sheets

AUTOMOTIVE-FLUID REPLACEMENT APPARATUS

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

The present invention relates generally to the art of fluid handling, and particularly to an apparatus for use in servicing an automotive vehicle such that a fluid reservoir forming a part of the vehicle can be drained and refilled.

Lubricants and other fluids are typically used in various components of a vehicle to facilitate proper functioning of the components. For example, front and rear differential assemblies, power transfer assemblies, manual transmission assemblies and transaxle assemblies all employ fluids, and each of these components are provided with a casing or other reservoir for storing such fluids.

Because fluids used in these and other components become contaminated and collect debris over time in operation, it is necessary to replace the fluids periodically. If the reservoir of the component includes a drain plug at a lower end thereof, replacement of the fluid is accomplished by first removing the drain plug to drain the old fluid, and then replacing the drain plug and refilling the reservoir with new fluid. Several different known methods are employed to refill the reservoirs of vehicle components. For example, the replacement fluid can be squeezed from a bottle, or a pressurized supply can be provided which dispenses new fluid to the emptied reservoir. Conventionally, pressurized systems dispense fluid under pressure to the reservoir either manually by a hand pump or pneumatically by a air-operated pump.

A known problem encountered in the use of the conventional methods is that the drain plug of a component leaks once it has been removed and replaced. Such leakage results when the plug is not fully tightened upon replacement, or when the seal of the plug fails. In either case, the problem creates the need for additional service to the vehicle, and is an unwanted distraction that increases the time required to perform the service.

If the component to be serviced does not include a drain plug a suction device is required for draining the old fluid. Typically, the suction device includes a line that is placed in the reservoir and a source of negative pressure such as an air-driven, venturi-effect vacuum that is connected to the line for drawing the fluid from the reservoir. Once the fluid is withdrawn from the reservoir with such a device, the vacuum line is removed, and the reservoir is refilled with replacement fluid in the manner described above.

BRIEF SUMMARY OF THE INVENTION

It is an object of the present invention to solve the technical problems left unaddressed by the prior art, and to provide a fluid replacement apparatus that can be used both to drain an old fluid from a reservoir and to refill the reservoir with a replacement fluid.

In accordance with these and other objects evident from the following description of a preferred embodiment of the invention, an apparatus is provided which includes a bi-directional pump having first and second ports, a service line connected to the first port and including a free end adapted for receipt in the reservoir of the vehicle, a supply line connected to the second port and including a free end adapted for receipt in the replacement fluid container, and a drain line connected to the second port. The supply line includes a check valve that permits fluid flow in a direction toward the pump while preventing the flow of fluid in a direction away from the pump, and the drain line includes a check valve that permits fluid flow in a direction away from the pump while preventing the flow of fluid in a direction toward the pump. A switch is provided on the apparatus, and is movable between an "off" position in which the pump is off, a first "on" position in which the pump operates in a first direction forcing fluid from the first port to the second port so that fluid is drained from the reservoir, and a second "on" position in which the pump operates in a second direction forcing fluid from the second port to the first port so that fluid from the container is pumped into the reservoir.

By providing a construction in accordance with the present invention, numerous advantages are realized. For example, the inventive construction permits the service line to be placed in the reservoir of a component at the beginning of the service and to remain in place during both draining of the original fluid and filling of the replacement fluid. Thus, it is not necessary to use separate means for draining the reservoir than for filling, and less time is required to perform the service. In addition, the inventive construction provides for the use of more than one replacement fluid so that additives and the like can be introduced by the apparatus during the service without requiring removal of the service line.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
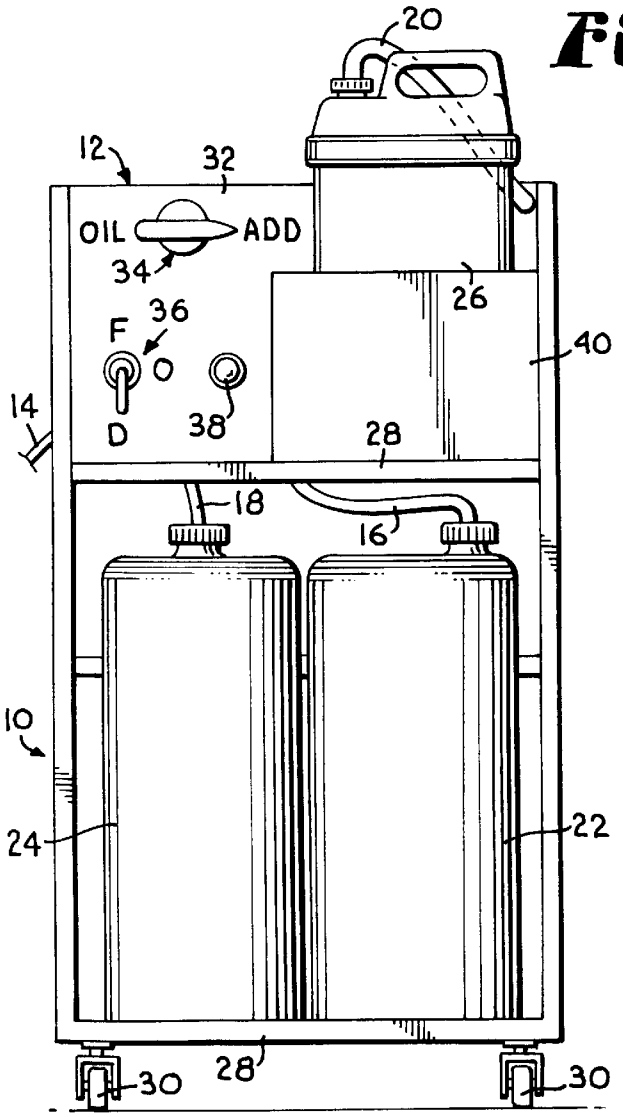
FIG. 1 is a front elevational view of a first fluid replacement apparatus constructed in accordance with the preferred embodiment of the present invention.

A fluid replacement apparatus is illustrated in FIG. 1, for use in servicing a car, truck, bus or other self-powered vehicle. In particular, the apparatus is constructed for use in draining used fluid from a differential, power transfer case, manual transmission, transaxle assembly or other component of the vehicle, and in replacing the used fluid with a new supply.

Broadly, the apparatus includes a cart 10, a pump assembly 12 supported on the cart, and a plurality of fluid transfer lines 14, 16, 18, 20 connected to the pump assembly for transferring fluids to and from a reservoir of the component to be serviced. In addition, the apparatus is intended to be used in combination with a used-fluid container 22, a replacement-fluid container 24, and an additive container 26, any one or all of which can be supported on the cart or separately therefrom.

The cart 10 includes a plurality of upstanding comer posts connected together by upper and lower support panels 28 and by rails that extend generally horizontally between the posts. A plurality of casters 30 are provided on the bottom of the cart for engaging the ground and permitting the apparatus to be transported from vehicle to vehicle between services. The pump assembly 12 is supported on the upper panel 28 of the cart 10, and side and top walls house the pump assembly to shield it during use. Preferably, the top wall is removable to permit servicing of the pump assembly, and one of the side walls presents a control panel 32 on which a valve actuator, a switch 36, and a circuit breaker 38 are disposed.

A receptacle 40 is supported on the upper panel 28 adjacent the pump assembly housing, and is adapted to receive the additive container 26 so that the container can be transported with the apparatus during use. In addition, the lower support panel of the cart is spaced from the upper panel to define an open area on the cart in which the used-fluid container 22 and/or the replacement-fluid container 24 can be positioned. As such, it is possible for the cart to permit the apparatus and all of the necessary containers to be rolled from vehicle to vehicle by a single person.

Figure 2:
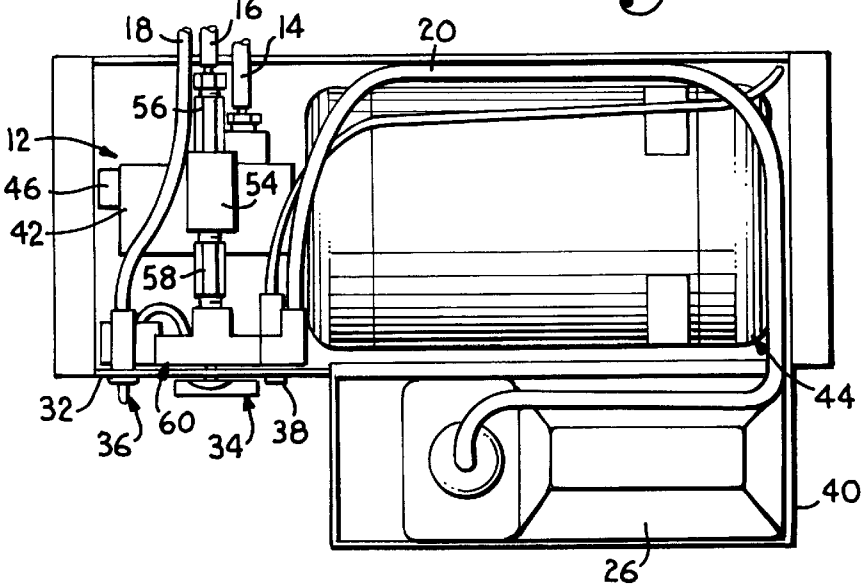
FIG. 2 is a top plan view of the apparatus.

The pump assembly 12 is illustrated in FIG. 2, wherein the top wall of the pump housing has been removed to expose the internal components of the apparatus. The pump assembly broadly includes a bi-directional fluid pump 42, a motor assembly 44 for driving the pump, and an electrical circuit for supplying electricity to the motor assembly and for controlling the direction of operation of the pump. The pump 42 in the preferred embodiment is a rotary gear head pump having a housing presenting a pair of ports 48, 50, shown in FIG. 3, and a power take-off. Returning to FIG. 2, a by-pass valve 46 is provided on the pump for relieving pressure from the pump above a predetermined magnitude, e.g. 75 p.s.i.

An impeller is operatively connected to the power take-off, and functions to pump fluid between the ports in either direction, depending on the direction of rotation of the impeller. When rotated in a first direction, fluid is drawn from the first port and forced from the second port. When rotated in the opposite direction, fluid is drawn from the second port and forced from the first port.

The motor assembly 44 includes an output shaft that connects to the power take-off of the pump for driving rotation of the impeller. Preferably, the motor assembly includes an electric motor such as a ⅓ HP omni-directional 115 V single phase 60 Htz motor. However, other types of motors may also be used to power the pump, e.g. hydraulic or pneumatic motors. In the motor assembly 44 of the preferred embodiment, an internal DC starter motor is provided which can be rotated in either direction by switching the polarity of the current to it. This starter motor rotates a primary AC motor in the same direction until the AC motor is up to speed, and then kicks out so that the AC motor continues to rotate in the same direction under AC power.

Figure 4:
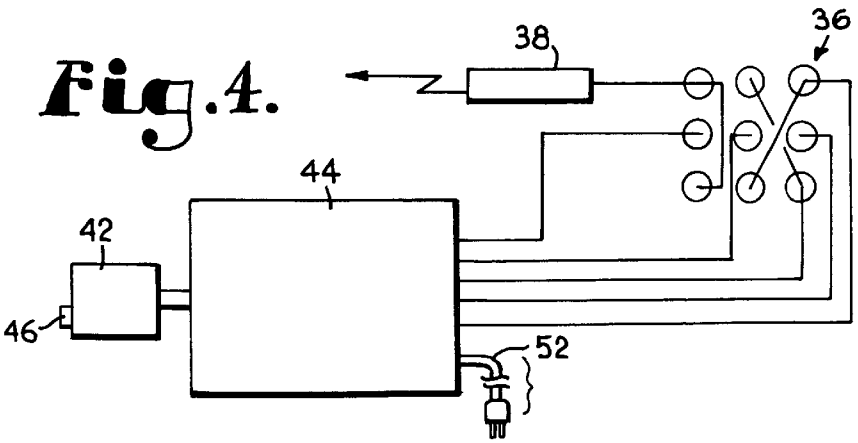
FIG. 4 is a schematic view of an electrical circuit forming a part of the apparatus.

As shown in FIG. 4, the electrical circuit includes a cord 52 adapted for connection to an AC power source, the switch 36 for controlling operation of the motor, and the circuit breaker 38 for protecting the circuit against shorts and other overload conditions. The switch 36 is a three-position switch presenting an "off" position and two "on" positions. In each position of the switch, three contacts are closed together. In the "off" position of the switch, power to both the DC starter motor and the primary AC motor is interrupted and the motor and pump are deactivated. In a first of the "on" positions, current of a first polarity is connected to the DC starter motor to initiate rotation of the primary motor in a first direction, and power is supplied to the primary motor. In the second "on" position, current of a polarity opposite the first polarity is connected to the DC starter motor to initiate rotation of the primary motor in a second direction opposite the first, and power is supplied to the primary motor. The circuit breaker is connected to the circuit in both of the "on" positions, and interrupts the current to the motor assembly in the event of a short or other over-current situation.

The fluid transfer lines 14, 16, 18, 20 are connected to the first and second ports 48, 50 of the pump. Broadly, there are a service line 14, a drain line 16, and a supply line 18 including separate replacement and additive fluid lines 24, 26. The service line 14 is preferably a single tube having a first end connected directly to the first port 48 of the pump and a second free end adapted for receipt in the reservoir to be serviced. Any suitable material can be used to form the tube, such as synthetic resin or metal tubing. If synthetic resin material is employed, it can be transparent or translucent in order to enable an operator to visually inspect the line to verify that fluid is flowing to or from the vehicle.

If desired, one or more attachments may be provided for connection to the free end of the service line, wherein each attachment is constructed for receipt on a particular type of component to be serviced. An exemplary attachment includes a cap sized for receipt on the fill opening of the component to be serviced, and a piece of tubing presenting opposed ends. An outer end of the tubing includes a hydraulic nipple or coupler that mates with a corresponding nipple or coupler on the free end of the service line so that the service line can be disconnected from the attachment subsequent to service without leaking fluid. The opposed inner end of the tubing is adapted to extend down into the reservoir of the component so that substantially all of the fluid in the reservoir can be drained during service. Preferably, the inner end of the tubing includes an irregular shape so that it does not bear flush against the inside of the component when suction is applied by the pump during service.

Figure 3:
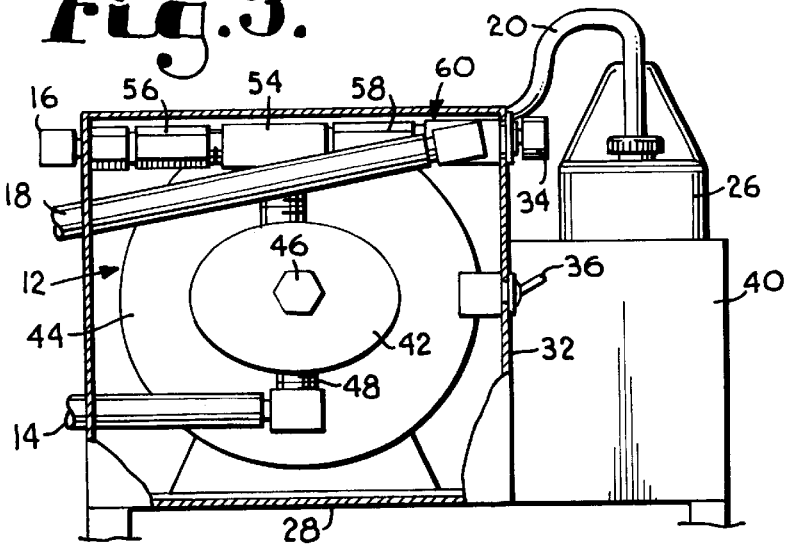
FIG. 3 is a side elevational view of the apparatus.

As shown in FIG. 3, in order to connect both the drain line 16 and the replacement fluid line 18 to the second port 50 of the pump, a T-shaped coupling 54 is provided. The coupling includes an inner passage presenting three interconnected branches, the first of which is connected to the second port 50 of the pump, the second of which connects to the drain line 16, and the third of which connects to the replacement fluid line 18.

A check valve 56 is provided in the drain line 16 immediately adjacent to the T-shaped coupling 54 for permitting fluid to flow past it only in a direction away from the coupling. When fluid flows in this direction, a ball or the like is unseated, and flow is permitted through the drain line. However, when the pump is reversed to draw fluid from the second port, the ball seats, preventing fluid from entering the coupling from the drain line. The line 16 includes a piece of clear tubing formed of a suitable synthetic resin material that is connected to the check valve 56, and presents a free end that can be placed in the used-fluid container so that fluid passing through the drain line is collected in the container for disposal.

A check valve 58 is provided in the replacement fluid line 18 immediately adjacent to the T-shaped coupling 54 for permitting fluid to flow past it only in a direction toward the coupling. When fluid flows in this direction, a ball or the like is unseated, and flow is permitted through the coupling to the pump. However, when the pump is reversed to force fluid out of the second port, the ball seats, preventing fluid from entering the supply line from the pump.

As shown in FIG. 2, a multiple-position ball valve assembly 60 or the like is provided in the replacement fluid line 18 adjacent the check valve 58, and an outlet port connected to the check valve 58 and a pair of inlet ports. The ball valve assembly 60 is constructed to bring one or the other of the inlet ports into fluid communication with the check valve depending on the position of the valve. The actuator 34 is provided on the valve assembly which protrudes through the control panel of the pump assembly housing. The actuator 34 is connected to a ball valve forming a part of the assembly 60 so that the position of the valve is controlled by movement of the actuator.

The lines 18, 20 are connected to the inlet ports of the multiple-position valve assembly 60. The line 18 presents a free end sized for receipt in the replacement-fluid container. The line 20 presents a free end sized for receipt in the additive container. Each line can be formed of any suitable material, depending on the nature of the fluid to be conveyed.

As illustrated in FIG. 1, in order to set the apparatus up for performing a fluid-replacement service on a vehicle, the used-fluid container 22, replacement-fluid container 24, and additive container 26 are placed on the cart 10, the drain line is inserted into the drain container, and the vampire tubes are placed in the containers. Thereafter, the cart is moved to a position near the vehicle to be serviced, and the power cord is plugged into an available AC power source.

The vehicle is prepared by removing the fill plug of the component to be serviced, and a suitable attachment may be fitted on the free end of the service line so that the line can be inserted into the reservoir of the component. As mentioned, the attachment presents an inner end that extends into the reservoir to a position adjacent the bottom thereof such that substantially all of the fluid in the reservoir can be drained with the apparatus.

Turning to FIG. 3, with the apparatus set up as described, the switch 36 is moved to the first "on" position in which the motor assembly and pump operate in a first direction, forcing fluid from the first port 46 of the pump toward and through the second port 50. This pumping action creates a negative pressure at the free end of the service line 14, drawing fluid in the component from the reservoir. The fluid flows through the service line 14, the pump 42 and the drain line 16 to the used-fluid container. The check valve 56 in the drain line permits the fluid to pass through it to the drain line. The check valve 58 prevents fluid from passing through it into the supply line.

The operator of the apparatus can inspect the clear drain line tube to determine when air bubbles are present, and this condition indicates that the fluid in the reservoir of the component is substantially drained. The pump 42 is allowed to continue pumping fluid from the reservoir for a short length of time to ensure that all of the fluid has been drained. Thereafter, the switch 36 is moved past the "off" position to the opposite "on" position, reversing the direction of operation of the motor assembly and pump. As such, fluid is drawn into the second port 50 of the pump and forced out the first port 48 to the service line.

If the ball valve of assembly 60 is set to bring the additive line 20 into fluid communication with the check valve 58, additive is drawn from the additive container under the negative pressure of the pump, and additive is transferred through the line 14 to the reservoir of the vehicle. The check valve 56 in the drain line 16 prevents any fluid in the drain line from being drawn back into the pump. The check valve 58 permits fluid from the supply line to be drawn into the pump.

Once the reservoir has been filled with a desired amount of additive, the actuator 34 is shifted to a position in which the replacement fluid line 18 communicates with the check valve. Thereafter, replacement fluid from the container 24 is drawn into the pump and conveyed to the component until the reservoir is filled. It is not necessary to shut off the pump when changing the position of the ball valve assembly. If additive is not to be used in a particular service, then the actuator 34 remains in one position.

After the reservoir has been both drained and refilled, the attachment that is used to connect the service line 14 to the component is removed from the service line and withdrawn from the fill hole of the component. By providing the service line 14 with a hydraulic coupling at its free end, no leakage occurs upon decoupling of the attachment. The fill plug of the component is replaced to complete the service.

Figure 5:
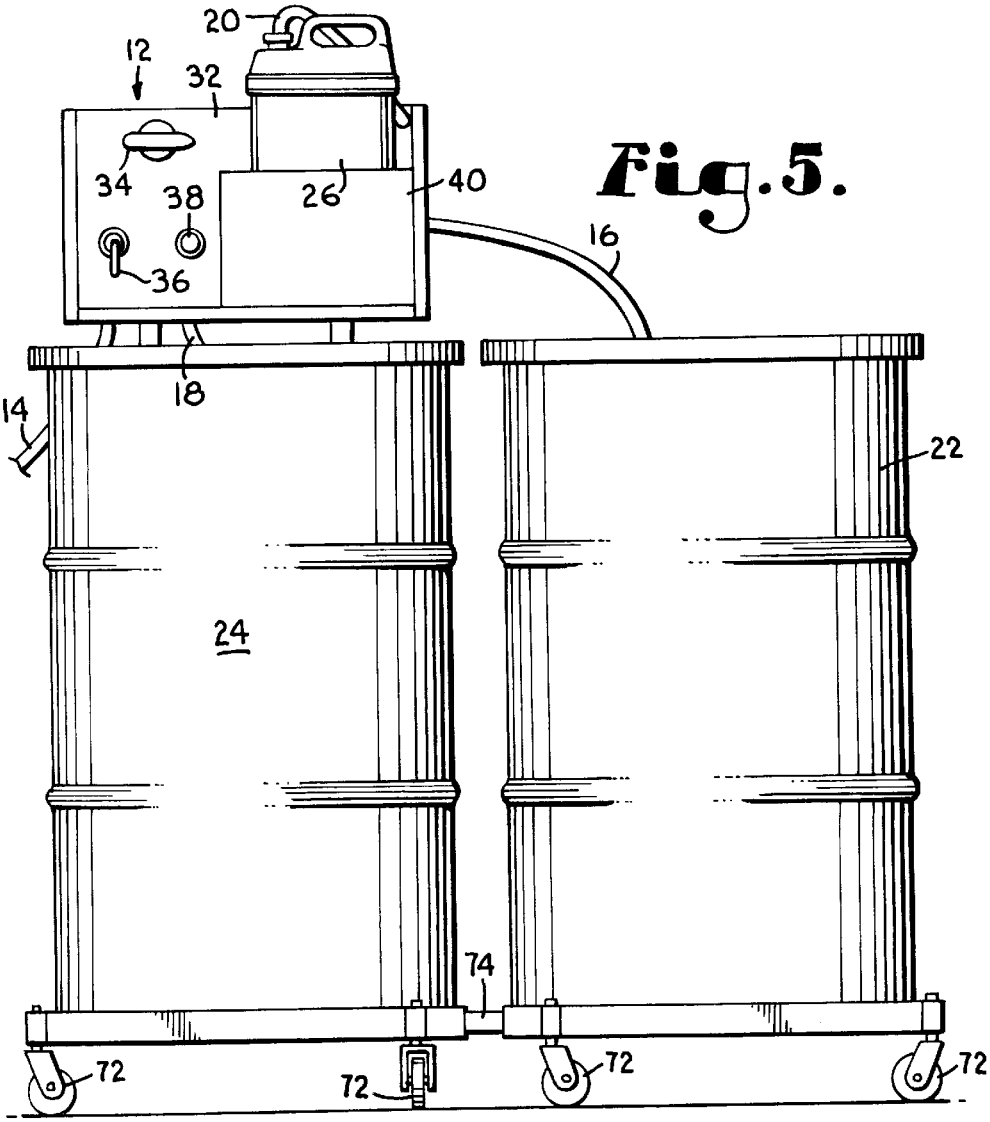
FIG. 5 is front elevational view of a second fluid replacement apparatus constructed in accordance with the preferred embodiment.

A second service apparatus constructed in accordance with the preferred embodiment is illustrated in FIG. 5, and broadly includes a support frame 70, a pump assembly 12 supported on the frame, and a plurality of fluid transfer lines 14, 16, 18, 20 connected to the pump assembly for transferring fluids to and from the component to be serviced. By making this modification to the apparatus, it is possible to mount the frame 70 directly on one of the containers 22, 24 so that the apparatus and containers can be rolled together between vehicles.

Preferably, the containers 22, 24 are 16 gallon drums that are each provided with castors 72 that support the drum for rolling movement over a floor. In addition, a hitch 74 can be provided on each drum for permitting two or more of the drums to be hitched together so that when one of the drums is moved, the other rolls with it.

The frame 70 includes a plurality of depending feet that support the apparatus on the top of one of the containers 22, 24, and clamps may be provided for clamping the frame in place to prevent it from being knocked from position. The pump assembly is supported by the frame, and side and top walls house the pump assembly to shield it during use. Preferably, the top wall is removable to permit servicing of the pump assembly, and one of the side walls presents the control panel on which the valve actuator 34, switch 36, and circuit breaker 38 are disposed. The pump assembly and fluid transfer lines are the same as in the apparatus described above, as is the method of servicing a vehicle.

Although the present invention has been described with reference to the preferred embodiment illustrated in the attached drawing figures, it is noted that substitutions may be made and equivalents employed herein without departing from the scope of the invention.

What is claimed is:

1. An apparatus for replacing a fluid employed in a vehicle component, wherein the fluid to be replaced is stored in a reservoir of the vehicle and a replacement fluid is stored in a separate container, the apparatus comprising:

a bi-directional pump having a first port and a second port;

a service line connected in fluid communication with the first port and including a free end adapted to be placed in fluid communication with the reservoir of the vehicle;

a supply line connected in fluid communication with the second port and including a first check valve that permits fluid flow in a direction toward the pump while preventing the flow of fluid in a direction away from the pump, the supply line being adapted for connection in fluid communication with the replacement fluid container;

a drain line connected in fluid communication with the second port and including a second check valve that permits fluid flow in a direction away from the pump while preventing the flow of fluid in a direction toward the pump; and a switch movable between an "off" position in which the pump is off, a first "on" position in which the pump operates in a first direction forcing fluid from the first port to the second port so that fluid is drained from the reservoir, and a second "on" position in which the pump operates in a second direction forcing fluid from the second port to the first port so that fluid from the container is pumped into the reservoir.

2. The apparatus as recited in claim 1, further comprising a coupling having a passage connected in fluid communication with the second port of the pump, the second check valve disposed in the drain line, and the first check valve disposed in the supply line.

3. The apparatus as recited in claim 1, further comprising a multiple-position valve including a first port connected in fluid communication with the first check valve, and at least two additional ports, the supply line including at least two vampire tubes connected to different ones of the additional ports of the multiple-position valve, the vampire tubes each including a free end adapted to be placed in fluid communication with replacement fluid.

4. The apparatus as recited in claim 3, wherein the multiple-position valve includes an actuator for shifting the valve between multiple positions in which one or the other of the vampire tubes is brought into fluid communication with the first check valve.

5. The apparatus as recited in claim 1, further comprising a cart for supporting the pump, the cart including ground-engaging wheels for allowing transport of the apparatus.

6. The apparatus as recited in claim 1, further comprising a frame for supporting the pump, the frame including a plurality of depending feet adapted to support the apparatus on top of a replacement-fluid container.

7. The apparatus as recited in claim 1, further comprising a drain container adapted to receive the fluid to be replaced, and a frame for supporting the pump, the frame including a plurality of depending feet adapted to support the apparatus on top of the used-fluid container.

8. The apparatus as recited in claim 1, further comprising an omni-directional motor for driving the pump in opposite directions.

9. A method of replacing a fluid stored in a reservoir of a vehicle component, comprising the steps of:

placing a service line in fluid communication between the reservoir and a first port of a bi-directional pump;

placing a drain line in fluid communication between a second port of the pump and a used-fluid container, the drain line including a check valve that permits fluid flow in a direction away from the pump while preventing the flow of fluid in a direction toward the pump;

placing a supply line in fluid communication between the second port of the pump and a replacement-fluid container, the supply line including a check valve that permits fluid flow in a direction toward the pump while preventing the flow of fluid in a direction away from the pump;

operating the pump in a first direction forcing fluid from the first port to the second port so that fluid is drained from the reservoir; and operating the pump in a second direction forcing fluid from the second port to the first port so that fluid from the replacement-fluid container is pumped into the reservoir.

10. The method as recited in claim 9, wherein a multiple-position valve presents a first port connected in fluid communication with the first check valve, and at least two additional ports, and wherein the step of placing the supply line in fluid communication between the second port of the pump and a replacement-fluid container includes connecting the supply line between one of the additional ports of the multiple-position valve and the replacement-fluid container, the method further comprising the step of placing an additive line in fluid communication between a second of the additional ports of the multiple-position valve and an additive container so that both replacement fluid and additive can be supplied to the reservoir when the pump is operated in the second direction.

11. The method as recited in claim 10, further comprising the step of shifting the multiple-position valve between multiple positions in which one or the other of the supply and additive tubes is brought into fluid communication with the first check valve.

* * * * *